US005611254A

United States Patent [19]

Rall

[11] Patent Number: 5,611,254

[45] Date of Patent: Mar. 18, 1997

[54] MULTIPLE HOLE PATTERN PAPER PUNCH APPARATUS

[76] Inventor: Douglas V. Rall, 74-991 Velie Way, Suite 1, Palm Desert, Calif. 92260

[21] Appl. No.: 347,690

[22] Filed: Dec. 1, 1994

[51] Int. Cl.[6] ..... B26F 1/02

[52] U.S. Cl. ..... 83/467.1; 83/618; 83/633; 83/687

[58] Field of Search ..... 83/948, 687, 618, 83/599, 167, 691, 467.1, 633

[56] References Cited

U.S. PATENT DOCUMENTS

| | | | |
|---|---|---|---|
| 430,315 | 6/1890 | House . | |
| 1,728,475 | 9/1929 | Cavill | 83/618 |
| 1,877,105 | 9/1932 | Wilkerson | 83/599 |
| 3,408,889 | 11/1968 | Murphy | 83/599 |
| 4,700,601 | 10/1987 | Simon | 83/687 |
| 4,713,995 | 12/1987 | Davi | 83/167 |
| 4,829,867 | 5/1989 | Neilsen . | |
| 4,879,932 | 11/1989 | Scalise et al. | 83/599 |
| 4,893,535 | 1/1990 | Bentrim et al. | 83/589 |
| 4,930,928 | 6/1990 | Ristuccia et al. | 402/80 R |
| 4,941,381 | 7/1990 | Garner | 83/589 |

FOREIGN PATENT DOCUMENTS

| | | | |
|---|---|---|---|
| 84353 | 2/1958 | Denmark | 83/687 |

*Primary Examiner*—Kenneth E. Peterson
*Attorney, Agent, or Firm*—Michael I. Kroll

[57] ABSTRACT

A multiple hole pattern paper punch apparatus, comprising a structure for punching holes simultaneously at specific location points into a sheet, so as to form corner pockets in the sheet which will receive and maintain corners of a flat article retained thereto.

3 Claims, 6 Drawing Sheets

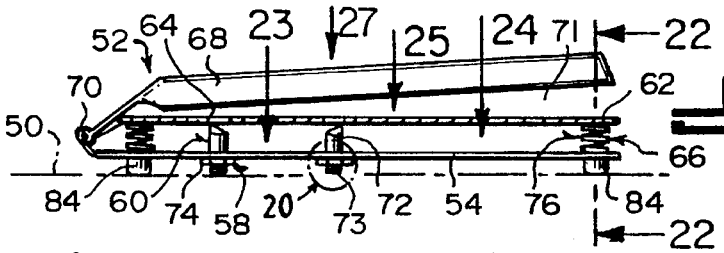
Fig. 19
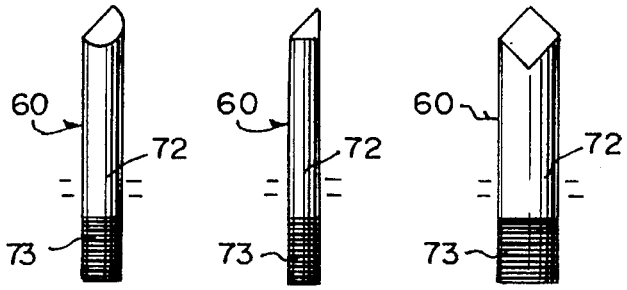
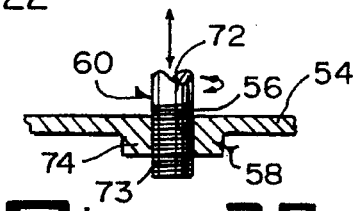
Fig. 20
Fig. 21
Fig. 22
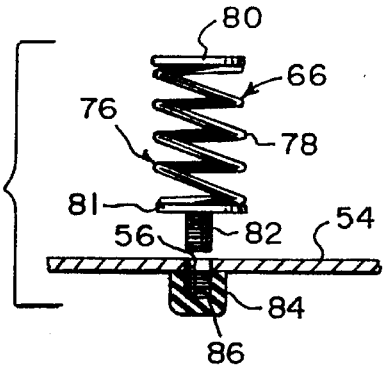
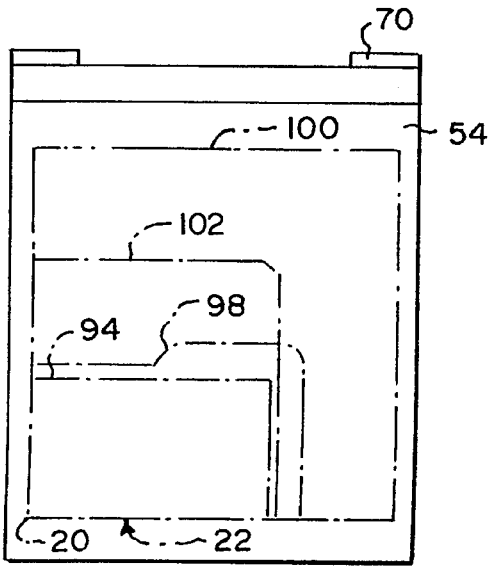
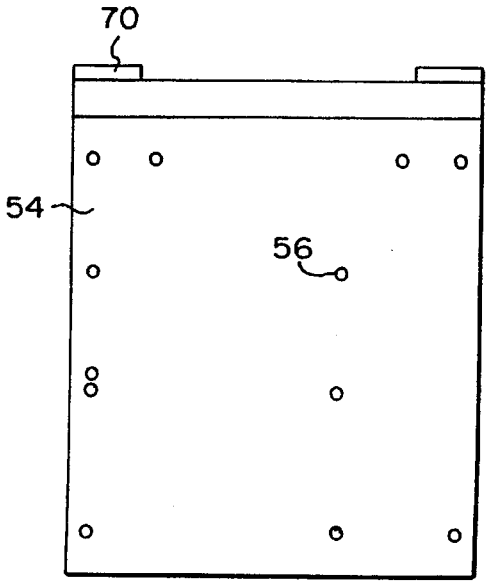
Fig. 23
Fig. 24

MULTIPLE HOLE PATTERN PAPER PUNCH APPARATUS

BACKGROUND OF THE INVENTION

1. Field of the Invention

The instant invention relates generally to paper punches and more specifically it relates to a multiple hole pattern paper punch apparatus.

2. Description of the Prior Art

Numerous paper punches have been provided in prior art. For example, U.S. Pat. Nos. 430,315 to House and 4,829,867 to Neilsen are illustrative of such prior art. While these units may be suitable for the particular purpose to which they address, they would not be as suitable for the purposes of the present invention as heretofore described.

HOUSE, JAMES ALFORD

PUNCH AND METHOD OF MAKING THE SAME

U.S. Pat. No. 430,315

A punch adapted for use in combination with a die. The punch consists of a folded or drawn sheet-metal portion adapted to enter the die. A shank has a socket flaring upwardly from its mouth and is adapted to contain the upper end of the cutting portion. A filling of fusible metal surrounds the cutting portion and holds the latter in proper position relative to the shank.

NEILSEN, HILDAUR L.

PAPER PUNCH APPARATUS WITH IMPROVED PUNCH ELEMENT

U.S. Pat. No. 4,829,867

A paper punch comprising a body defining a gap for insertion of the material to be punched and has at least one punch hole at the bottom of the gap. Guides are for guiding a punching element across the gap into the punch hole. At least one cylindrical punching element is disposed to be guided into the punch hole and has a cutting end with a cutting edge which extends helically along at least one-half of the circumference of the punching element. Preferably the punching element is hollow and is formed from a shaped sheet of metal.

SUMMARY OF THE INVENTION

A primary object of the present invention is to provide a multiple hole pattern paper punch apparatus that will overcome the shortcomings of the prior art devices.

Another object is to provide a multiple hole pattern paper punch apparatus that contains a plurality of hole punch bits at various location points, whereby when holes are punched out in a piece of paper or folder by the hole punch bits, corner pockets are formed to receive corners of a flat article, so that the flat article can be retained thereto.

An additional object is to provide a multiple hole pattern paper punch apparatus, in which the hole punch bits are adjustable with respect to the various location points, so that the apparatus can be adaptable to accommodate the insertion of the corners of the flat article into the corner pockets, whereby to flat article can be a business card, a Roladex card, a display card, a small hand computer disc, a large floppy computer disc, a photograph and any other similar article.

A further object is to provide a multiple hole pattern paper punch apparatus that is simple and easy to use.

A still further object is to provide a multiple hole pattern paper punch apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 19 is a side view of a second embodiment of the instant invention, with parts in section.

FIG. 20 is an enlarged cross sectional view taken in the area indicated by arrow 20 in FIG. 19.

FIG. 21 is an elevational view showing three different types of hole punch bits.

FIG. 22 is an enlarged partly exploded cross sectional view taken along line 22—22 in FIG. 19.

FIG. 23 is a diagrammatic top view of the base plate taken in the direction of arrow 23 in FIG. 19, showing an overlay pattern in phantom lines of some of the various flat articles that can be retained to the piece of paper or folder.

FIG. 24 is a diagrammatic top view of the base plate taken in the direction of arrow 24 in FIG. 19, showing various location points of the hole punch bits to accommodate the various flat articles shown in FIG. 23.

FIG. 25 is a diagrammatic top view of the floating plate taken in the direction of arrow 25 in FIG. 19, showing clearance apertures for the hole punch bits to pass through.

Similar reference characters denote corresponding features consistently throughout the attached drawings.

DETAILED DESCRIPTION OF THE PREFERRED EMBODIMENTS

Figure 1:
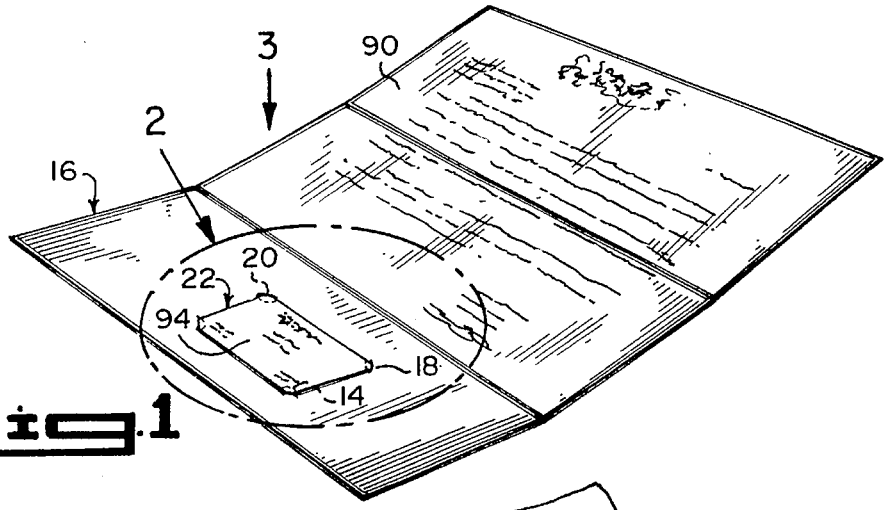
FIG. 1 is a perspective view of a piece of paper showing four corners of a business card retained in place in four corner pockets formed by semicircular holes punched out by the instant invention.

Turning now descriptively to the drawings, in which similar reference characters denote similar elements throughout the several views, FIGS. 1 through 18 illustrate a multiple hole pattern paper punch apparatus 10, comprising a structure 12 for punching holes 14 simultaneously at specific location points into a sheet 16, so as to form corner pockets 18 in the sheet 16 which will receive and maintain corners 20 of a flat article 22 retained thereto.

The hole punching structure 12 includes a plurality of hole punch bits 24. Each hole punch bit 24 consists of an elongated shank portion 26 and a cutting tip end 28 on the elongated shank portion 26. The cutting tip end 28 is of a particular geometric configuration.

The multiple hole pattern paper punch apparatus 10, further contains a base plate 30 having a plurality of apertures 32 at the specific location points. A guide housing 34 is attached at one end to the base plate 30, so as to form a gap 36 therebetween for insertion of the sheet 16 therein. Assemblies 38 in the guide housing 34, is for directing the hole punch bits 24 across the gap 36 into the apertures 32. A handle 40 is hinged at one end 42 to the guide housing 34. A plurality of punch press members 44 are in a bottom surface 45 of the handle 40. When the handle 40 is pressed down, the punch press members 44 will drive the hole punch bits 24 through the directing assemblies 38 in the guide housing 34, to punch holes 14 simultaneously at the specific location points into the sheet 16.

A catch basin 46 can be mounted in a removable manner to the underside of the base plate 30, so as to capture all small particles of the sheet 16 after holes 14 are punched out. A plurality of rubber feet 48 are affixed to the underside of the catch basin 46, to stabilize the apparatus 10 upon a flat surface 50.

An alternate multiple hole pattern paper punch apparatus 52 is shown in FIGS. 19 through 27 and includes a base plate 54 having a plurality of apertures 56 at a variety of specific location points. Units 58 are for mounting hole punch bits 60 into the apertures 56 in the base plate 54 in a variety of combinations, so that the hole punch bits 60 will extend upwardly therefrom. A float platform 62 has a plurality of clearance openings 64 in the same array as the apertures 56 in the base plate 54. Components 66 are for supporting the float platform 62 in a spring biased manner over the base plate 54. The clearance openings 64 are located directly above all of the apertures 56 in the base plate 54, to allow the hole punch bits 60 in the base plate 54 to pass therethrough. A press handle 68 is hinged at one side 70 to the float platform 62 and the base plate 54, so that there will be a gap 71 between the float platform 62 and the press handle 68 for insertion of the sheet 16 therein. When the press handle 68 is pressed down, the float platform 62 with the sheet 16 will move down. The hole punch bits 60 will punch holes 14 simultaneously at the specific location points into the sheet 16.

The mounting units 58 consist of each shank portion 72 of each hole punch bit 60 threaded at a lower end 73. A plurality of lock nuts 74 are provided. Each lock nut 74 is affixed to the underside of the base plate 54 directly below one aperture 56. The threaded lower end 73 of the shank portion 72 of each hole punch bit 60 can be threaded therein to each lock nut 74.

The supporting components 66 are four spring assemblies 76, each of which is mounted at one corner of the base plate 54 and under one corner of the float platform 62. Each spring assembly 76 contains a compressible spring 78. A pair of washers 80 and 81 are provided, with each affixed to an opposite end of the spring 78. A threaded stub shaft 82 extends downwardly from the lower washer 81 and through one aperture 56 in a corner of the base plate plate 54. A rubber pad 84 has a threaded bore 86, to engage with the threaded stub shaft 82 under the base plate 54. The rubber pads 84 will stabilize the apparatus 52 upon a flat surface 50.

Figure 26:
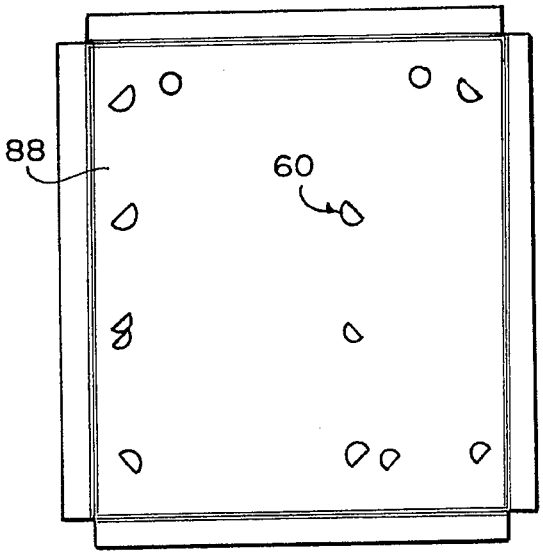
FIG. 26 is a diagrammatic flattened out top view of a combination scrap receptacle and punch bit die, which can be mounted in a removable manner onto a press handle of the second embodiment.
Figure 27:
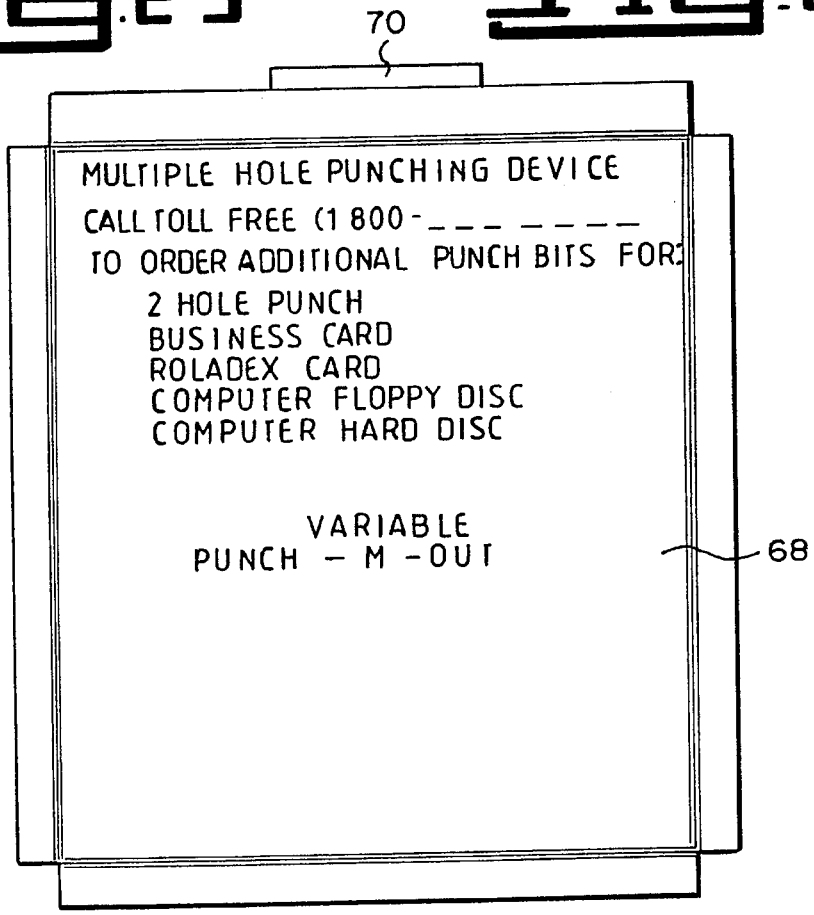
FIG. 27 is a diagrammatic flattened top view of the press handle as indicated by arrow 27 in FIG. 19.

FIG. 26 shows a combination scrap receptacle and punch bit die 88, which can be affixed in a removable manner directly onto the press handle 68. The hole punch bits 60 are mounted directly onto the base plate 54. All small particles of the sheet 16 will be captured after holes 14 are punched out.

Figure 2:
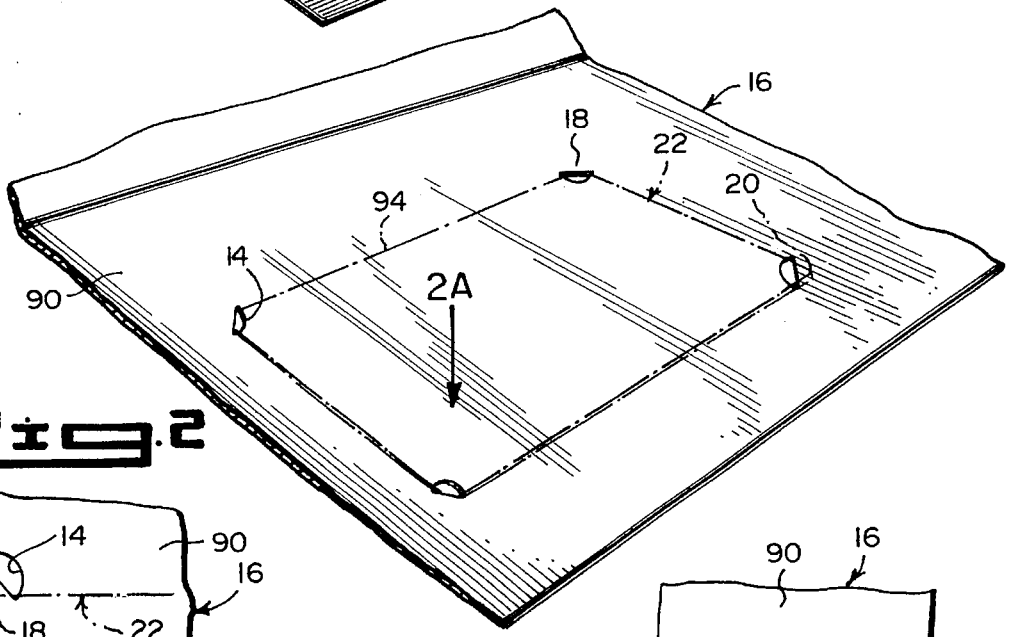
FIG. 2 is an enlarged perspective view of a portion of the piece of paper as indicated by arrow 2 in FIG. 1, showing the business card in phantom lines.
Figure 2A:
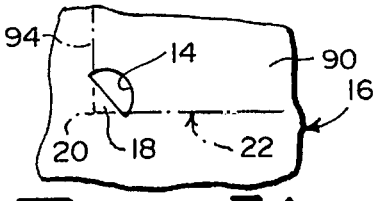
FIG. 2A is an enlarged top view of a portion of the piece of paper taken in the direction of arrow 2A in FIG. 2, showing one of the corner pockets in greater detail.
Figure 3:
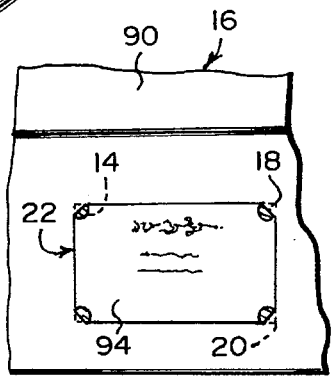
FIG. 3 is a top view of a portion of the piece of paper taken in the direction of arrow 3 in FIG. 1, showing the business card retained in place.
Figure 4:
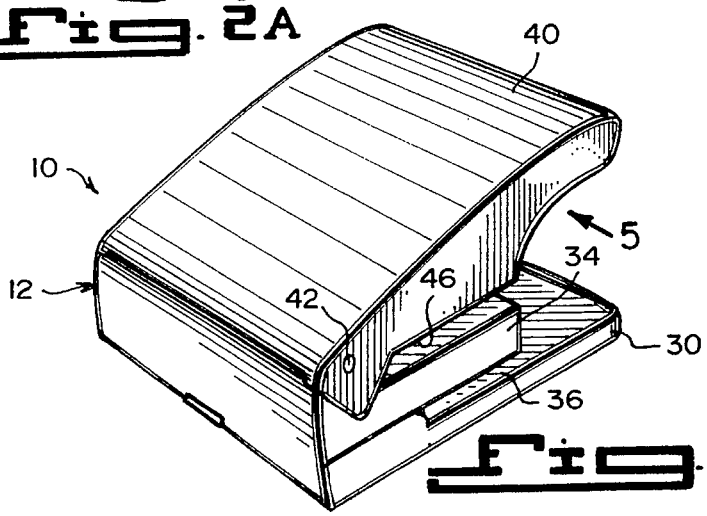
FIG. 4 is a perspective view of a first embodiment of the instant invention.
Figure 5:
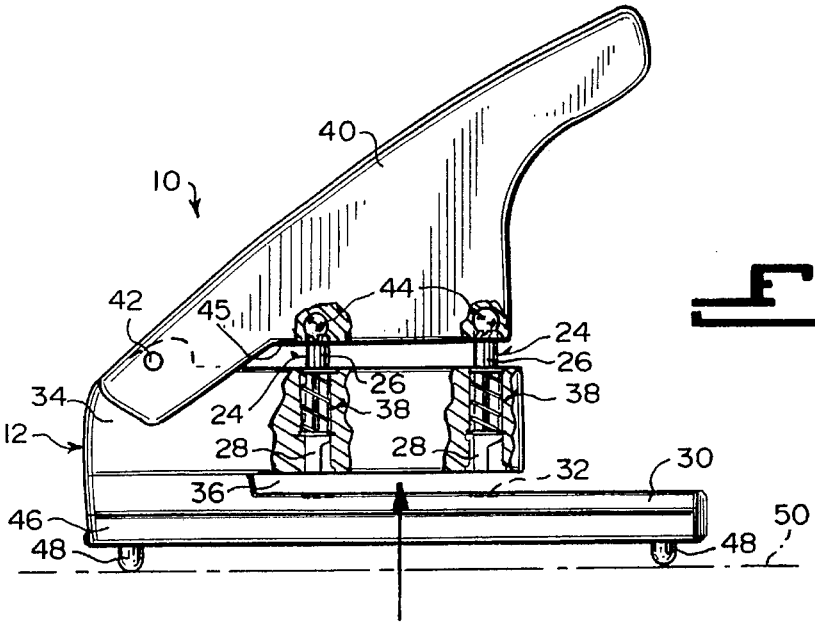
FIG. 5 is a side view taken in the direction of arrow 5 in FIG. 4, with parts broken away and in section.

The sheet 16 can be a piece of paper 90, as shown in FIGS. 1 through 3. The sheet 16 can also be a folder 92, as shown in FIGS. 12 through 18.

Figure 6:
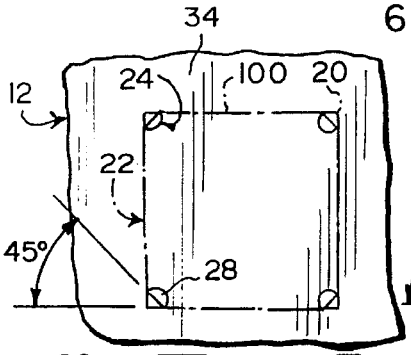
FIG. 6 is a diagrammatic bottom view of a portion of the guide housing, taken in the direction of arrow 6 in FIG. 5, with a four corner arrangement of semicircular hole punch bits for a large floppy computer disc that is shown in phantom lines.
Figure 11:
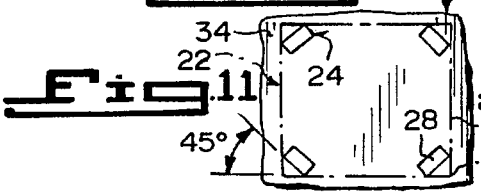
FIG. 11 is a diagrammatic bottom view of a portion of the guide housing, similar to FIG. 10, with a four corner arrangement of rectangular hole punch bits for the large floppy computer disc that is shown in phantom lines.
Figure 11A:
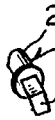
FIG. 11A is a perspective view of a tip end of one rectangular hole punch bit in FIG. 11.
Figure 12:
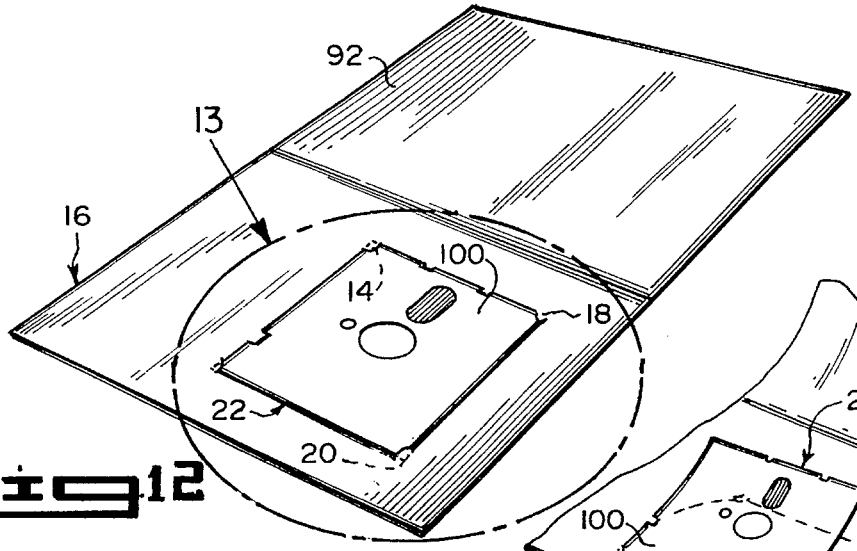
FIG. 12 is a perspective view of a folder showing four corners of the large floppy computer disc retained in place in four corner pockets formed by semicircular holes punched out by the instant invention.
Figure 13:
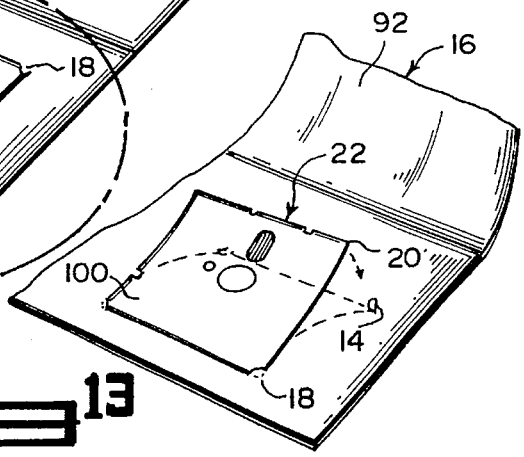
FIG. 13 is a perspective view of a portion of the folder as indicated by arrow 13 in FIG. 12, showing the large floppy computer disc being installed.
Figure 14:
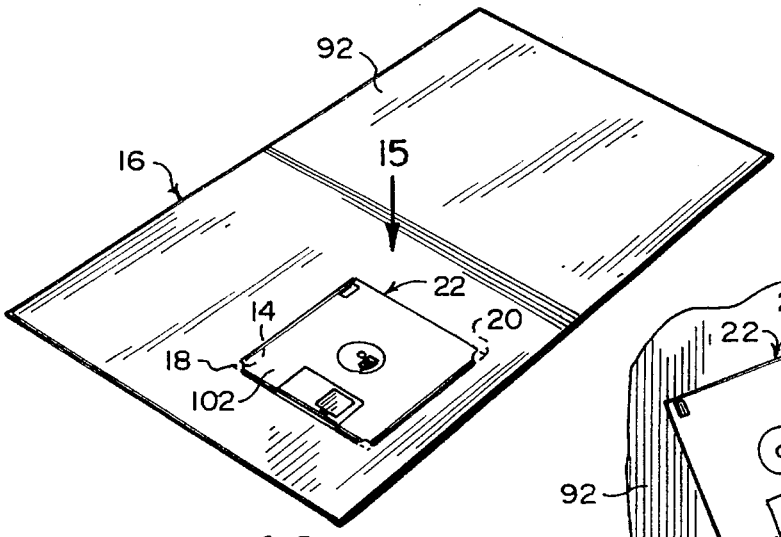
FIG. 14 is a perspective view of a folder, showing three corners of a small hard computer disc retained in place in three corner pockets formed by semicircular holes punched out by the instant invention.
Figure 15:
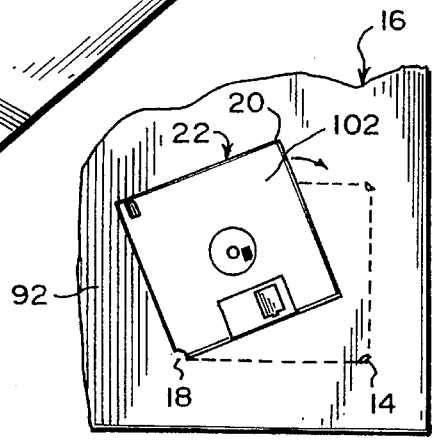
FIG. 15 is a top view of a portion of the folder taken in the direction of arrow 15 in FIG. 14, showing the small hard computer disc ready to be installed.
Figure 16:
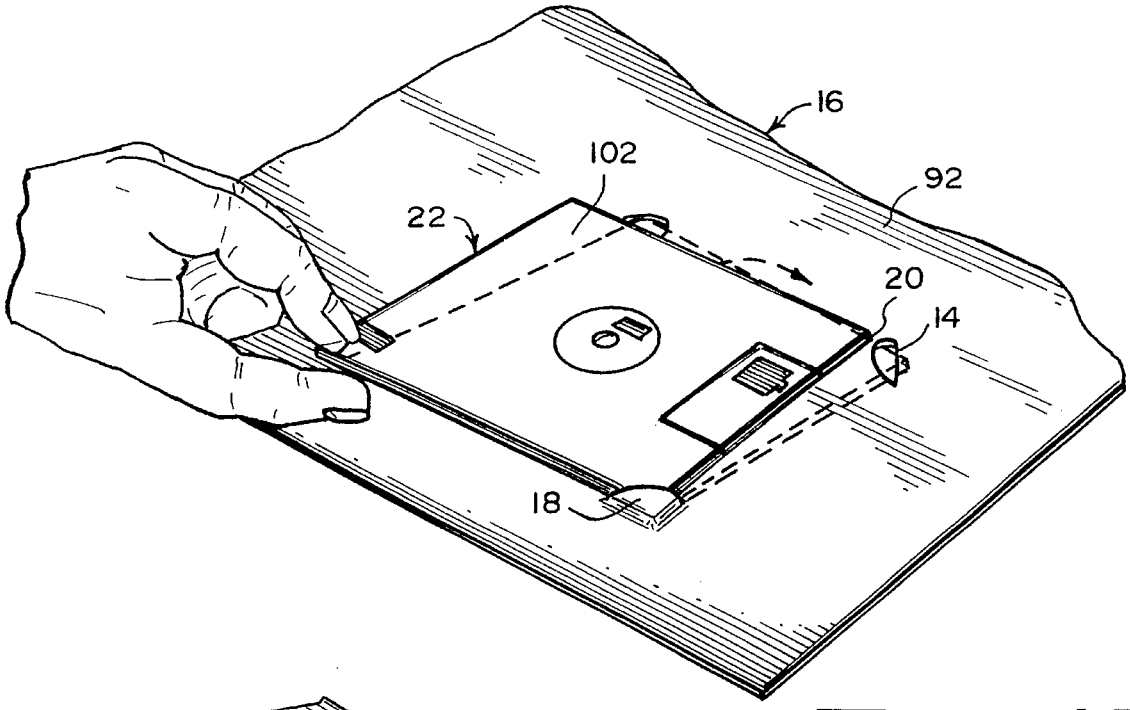
FIG. 16 is a perspective view of a portion of the folder, showing the small hard computer disc being installed.
Figure 17:
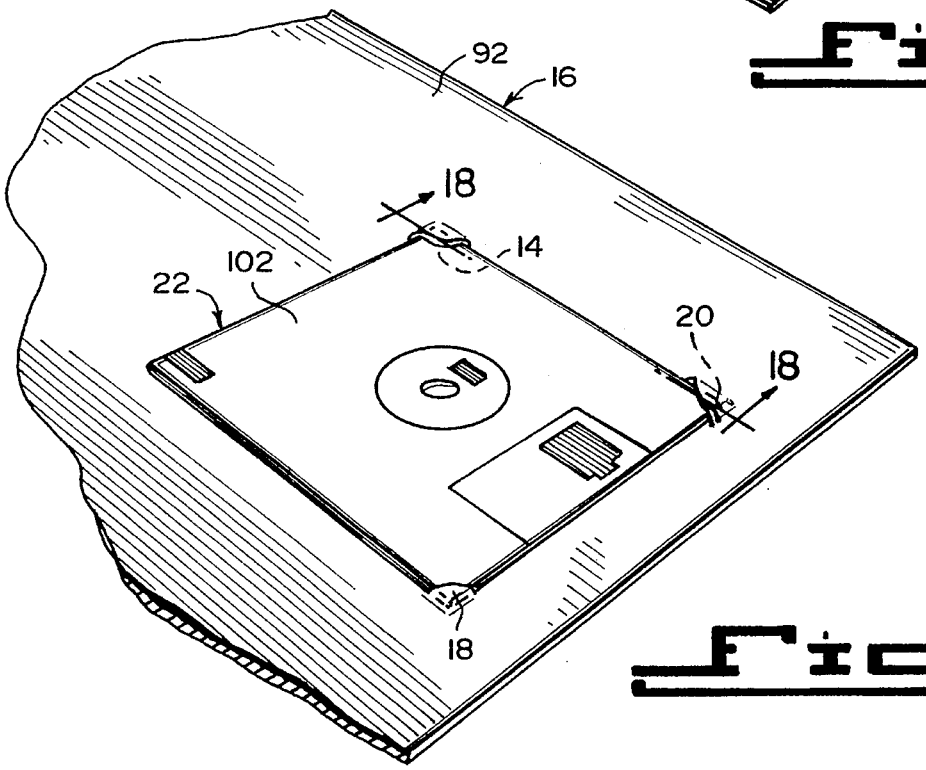
FIG. 17 is a perspective view of a portion of the folder, showing the small hard computer disc completely installed and retained in place.
Figure 18:
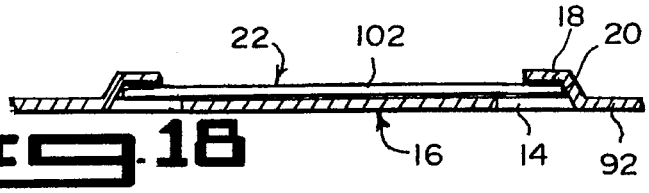
FIG. 18 is a cross sectional view taken along line 18—18 in FIG. 17.
Figure 25:
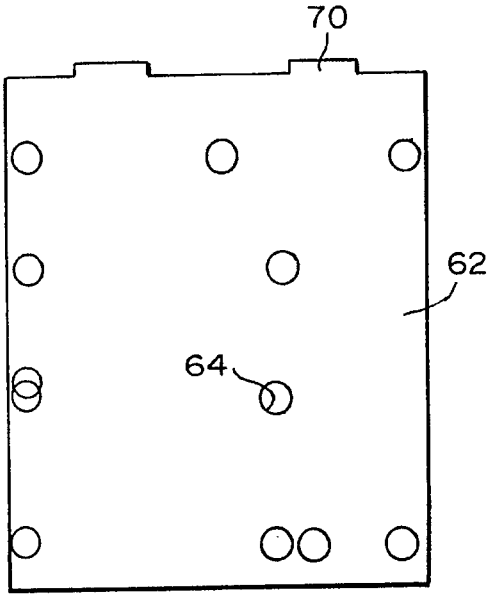

As best seen in FIG. 6, the geometric configuration of the cutting tip end 28 of the hole punch bit 24 can be semicircular with its straight side positioned approximately at a forty five degree angle with respect to the corner 20 of the flat article 22. As best been in FIG. 7, the geometric configuration of the cutting tip end 28 of the hole punch bit 24 can be triangular with one straight side positioned approximately at a forty five degree angle with respect to the corner 20 of the flat article 22. As best seen in FIG. 8, the geometric configuration of the cutting tip end 28 of the hole punch bit 24 is circular and is positioned tangent to two sides of the corner 20 of the flat article 22. As best seen in FIG. 11, the geometric configuration of the cutting tip end 28 of the hole punch bit 24 is rectangular with one long straight side positioned approximately at a forty five degree angle with respect to the corner 20 of the flat article 22.

Figure 7:
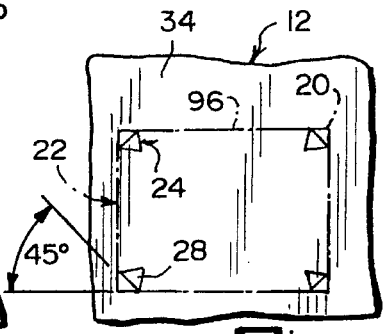
FIG. 7 is a diagrammatic bottom view of a portion of the guide housing, similar to FIG. 6, with a four corner arrangement of triangular hole punch bits for the business card that is shown in phantom lines.
Figure 8:
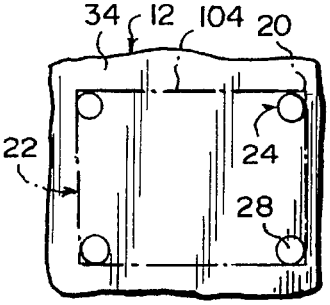
FIG. 8 is a diagrammatic bottom view of a portion of the guide housing, similar to FIG. 7, with a four corner arrangement of circular hole punch bits for a photograph that is shown in phantom lines.
Figure 6A:
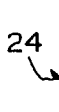
FIG. 6A is a perspective view of a tip end of one semicircular hole punch bit in FIG. 6.
Figure 7A:
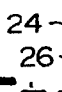
FIG. 7A is a perspective view of a tip end of one triangular hole punch bit in FIG. 7.
Figure 8A:
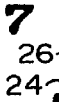
FIG. 8A is a perspective view of a tip end of one circular hole punch bit in FIG. 8.
Figure 9:
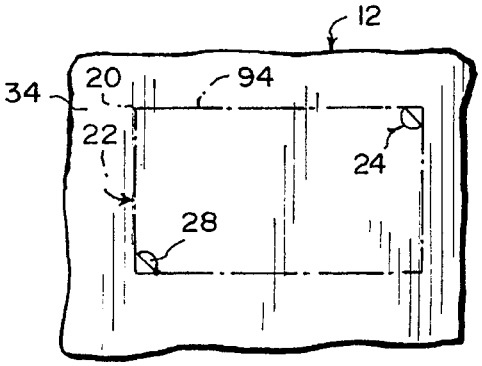
FIG. 9 is a diagrammatic bottom view of a portion of the guide housing, similar to FIG. 8, with a two diagonal corner arrangement of the semicircular hole punch bits for the business card that is shown in phantom lines.
Figure 10:
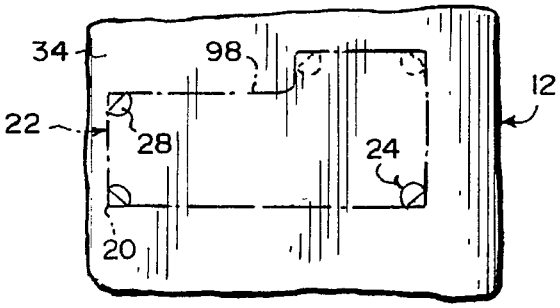
FIG. 10 is a diagrammatic bottom view of a portion of the guide housing, similar to FIG. 9, with a multi-corner arrangement of semicircular hole punch bits for a Roladex card that is shown in phantom lines.

The flat article 22 can be a business card 94 as shown in FIGS. 1 through 3, 9 and 23, a display card 96 as shown in FIG. 7, a Roladex card 98 as shown in FIGS. 10 and 23, a large floppy computer disc 100 as shown in FIGS. 6, 11 through 13 and 23, a small hard computer disc 102 as shown in FIGS. 14 through 18 and 23, a photograph 104 as shown in FIG. 8, or any other similar flat article.

The apparatus 52 can be modified in that it can be flipped over, which would result in the hole punch bits 60 coming down from the press handle 68. Eliminate the float platform 68 and have the combination scrap receptacle and punch bit die 88 serve as the base plate 54. Also, there can be a further modification of the way the hole punch bits 60 are actually mounted.

LIST OF REFERENCE NUMBERS

10 multiple hole pattern paper punch apparatus
12 hole punching structure of 10
14 hole in 16
16 sheet
18 corner pocket in 16
20 corner of 22
22 flat article
24 hole punch bits in 12
26 elongated shank portion of 24
28 cutting tip end of 24
30 base plate of 10
32 aperture in 30
34 guide housing of 10
36 gap between 30 and 34
38 directing assembly in 34
40 handle of 10
42 hinge between 34 and 40
44 punch press pin in 40
45 bottom surface of 40
46 catch basin on 30
48 rubber foot on 46
50 flat surface
52 alternate multiple hole pattern paper punch apparatus
54 base plate of 52
56 aperture in 54
58 mounting unit for 60
60 hole punch bit
62 float platform of 52
64 clearance opening in 62
66 supporting component for 62
68 press handle of 52
70 hinge between 54, 62 and 68
71 gap between 62 and 68
72 shank portion of 60
73 threaded lower end of 72
74 lock nut on 54 under 56
76 spring assembly for 66
78 compressible spring of 76
80 upper washer on 78
81 lower washer on 78
82 threaded stub shaft on 81
84 rubber pad
86 threaded bore in 84
88 combination scrap receptacle and punch bit die on 68
90 piece of paper for 16
92 folder for 16
94 business card for 22
96 display card for 22
98 Roladex card for 22
100 large floppy computer disc for 22
102 small hard computer disc for 22
104 photograph for 22

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multiple hole pattern paper punch apparatus for punching holes simultaneously at specific location points into a sheet, so as to form corner pockets in said sheet which will receive and maintain corners of a flat article retained thereto comprising:

a) base plate means having a plurality of apertures at specific location points corresponding to the corners of said flat article to be retained;

b) guide housing means attached at one end to said base plate forming a gap with a lateral sheet abutment between said housing and said base plate, means for insertion of a sheet therein in which holes in a predetermined pattern are to be punched corresponding to the corners of said flat article;

c) a plurality of hole punch bits mounted within said guide housing and aligned with said apertures in said base plate means, each of said hole punch bits consisting of an elongated shank portion and a cutting tip end designed to cut out a piece of said sheet having a specific geometric configuration;

d) handle means hinged at one end to said guide housing means having mounted in a bottom surface thereof a plurality of press members aligned with all of said hole punch bits so that when said handle means is pressed down said press members to drive all of said hole punch bits out through said base plate means through said gap to punch holes simultaneously at said specific location points through said sheet; and e) at least one said plurality of punch bits being spaced further from said abutment than another of said plurality of punch bits and said base plate means having at least three different apertures at at least three different distances from said abutment.

2. A multiple hole pattern paper punch apparatus as recited in claim 1, wherein said sheet is a piece of paper.

3. A multiple hole pattern paper punch as recited in claim 1, wherein said sheet is a folder.

* * * * *